United States Patent [19]

Woodard

[11] 4,332,647

[45] Jun. 1, 1982

[54] COMPOSITION AND METHOD FOR ELECTRODEPOSITION OF BLACK NICKEL

[75] Inventor: Stephen K. Woodard, Loveland, Ohio

[73] Assignee: Hooker Chemicals & Plastics Corp., Warren, Mich.

[21] Appl. No.: 197,873

[22] Filed: Oct. 17, 1980

[51] Int. Cl.[3] ..... C25D 3/12
[52] U.S. Cl. ..... 204/49
[58] Field of Search ..... 204/49; 204/43 T

[56] References Cited

U.S. PATENT DOCUMENTS 4,244,790 1/1981 Wieczerniak ..... 204/49

OTHER PUBLICATIONS

E. J. Roehl et al., Reprinted from Feb. 1950, issue of Plating.

*Primary Examiner*—G. L. Kaplan
*Attorney, Agent, or Firm*—Richard P. Mueller; Arthur E. Kluegel

[57] ABSTRACT

A process and aqueous composition for electro-depositing a uniform, adherent substantially black nickel deposit on a conductive substrate. The aqueous solution is of a pH ranging from about 4 to about 12 and contains nickel ions, borate ions, conductivity salts and a controlled effective amount of a selected class of bath soluble amines to attain the black nickel deposit. The aqueous solution may further optionally contain supplemental darkening enhancing agents and wetting agents of the types conventionally employed in nickel electroplating solutions.

16 Claims, No Drawings

COMPOSITION AND METHOD FOR ELECTRODEPOSITION OF BLACK NICKEL

BACKGROUND OF THE INVENTION

A variety of processes and solutions have heretofore been used or proposed for use to deposit a dark or substantially black nickel deposit on various conductive substrates. Such so-called black nickel deposits are particularly suitable for various decorative purposes as well as to promote absorption of radiant energy such as in solar heating systems, and the like. Typical of such prior art techniques for depositing a black coating or black nickel deposit on metallic substrates are those disclosed in U.S. Pat. Nos. 2,679,475; 2,844,530; 3,127,279; 3,681,211 and 3,753,873.

A continuing problem associated with such prior art techniques has been the difficulty in controlling the composition and process to consistently achieve substantially black coatings which are adherent to the substrate, which provide for improved corrosion resistance, and which are receptive to receiving a clear lacquer or other siccative finish coating.

A recent improvement in an electrolyte composition and process for overcoming many of the problems and disadvantages associated with prior art techniques for electrodepositing dark nickel platings is disclosed in United States Patent Application Ser. No. 71,610 filed Aug. 31, 1979, now U.S. Pat. No. 4,244,790. It has been found in some instances, however, that the aforementioned improved electrolyte produces non-uniformity in the dark nickel deposit in high current density areas and rainbow colors and/or skip plate in low current density areas of parts of complex configuration during commercial rack plating operations.

The present invention provides for a still further improvement in the art of dark or black nickel plating of parts of complex configuration by providing an electrolyte and process which achieves an increase in the rate of electrodeposition over a broad range of current densities, pH, bath concentration and temperature and is adaptable for use on a variety of different conductive substrates achieving consistent, substantially uniform black nickel deposits in low, intermediate as well as high current density areas. The dark nickel deposits are further characterized by their good corrosion resistance, adhesion and receptivity to a variety of clear lacquer finish coats.

SUMMARY OF THE INVENTION

The benefits and advantages of the present invention are achieved by an operating bath which comprises an aqueous solution having a pH ranging from about 4 up to about 12 and containing as its essential constituents, about 2 to about 25 grams per liter (g/l) nickel ions, about 10 g/l up to bath solubility of conductivity salts, at least about 7 g/l up to bath solubility of borate ions, and a bath soluble amine present in an amount to provide a mol ratio of nickel to amine in the solution of from about 1:1 to about 1:4. Bath soluble amines suitable for this purpose are of the formula:

$$R—NH—[(CH_2)_n—NH]_m—(CH_2)_p—X—R'$$

Wherein:

n, m, and p are integers and n is 2 or 3, m is 1 or 2 or 3, and p is 2 or 3;

X is O or NH; and

R and R' are the same or different and are H, $—CH_2CH=CH_2$, $—CH_2CH_2CH_2SO_3$ or $$—CH_2\underset{\underset{OH}{|}}{C}HCH_2OH$$

Typical of the foregoing amines are triethylene tetramine, dipropylene triamine and 2-(2-amino ethylamino) ethanol.

The operating bath may further optionally contain darkening enhancing agents comprising alkali metal salts of sulfur containing compounds such as thiocyanates, thiosulfates, bisulfites, sulfites and the like, which may be present in amounts up to about 25 g/l. The bath may optionally further contain small controlled amounts of wetting agents of the types conventionally employed in nickel electroplating solutions.

In accordance with the method aspects of the present invention, the electroplating bath can operate at from room temperature (70° F.) up to about 150° F. over a current density range of about 2 up to about 25 amperes per square foot (ASF). Plating times can vary from about 1 up to about 10 minutes depending upon bath composition and process variables.

Additional benefits and advantages of the present invention will become apparent upon a reading of the description of the preferred embodiments taken in conjunction with the specific examples provided.

DESCRIPTION OF THE PREFERRED EMBODIMENTS

The novel electroplating bath of the present invention for depositing so-called black nickel deposits comprises an aqueous solution containing as its essential constituents a controlled effective amount of nickel ions, bath soluble inert salts to increase the conductivity of the solution, borate ions and a bath soluble amine present in a controlled amount depending upon the concentration of nickel ions present. The nickel ion concentration can broadly range from about 2 g/l up to about 25 g/l with amounts ranging from about 6 to about 10 g/l being preferred. Concentration of nickel ions above about 25 g/l is undesirable in some instances in that the nickel deposit formed tends to have a gray appearance at such higher concentrations. The nickel ions can be conveniently introduced into the bath in the form of bath compatible and soluble nickel salts such as nickel sulfate, nickel halide salts, nickel sulfonate, nickel fluoborate, and the like. Of the foregoing, nickel sulfate in the form of the hexahydrate comprises a preferred source. The nickel halide salts can be satisfactorily employed when a nickel anode is employed in the operating bath but are not desirable when inert anodes such as carbon anodes are employed due to the evolution of the corresponding halide gas at the anode. Nickel sulfate provides a further advantage when a nickel anode is employed in that the solution does not as readily attack the surface of the anode and the build-up of nickel ion concentration in the bath is substantially slower providing further simplicity in the control of the operating bath.

A second essential constituent of the electroplating bath is a controlled amount of borate ions which are present in an amount of at least about 7 g/l up to bath solubility with amounts of about 15 to about 30 g/l being preferred. The borate ions can be introduced by boric acid as well as the bath soluble alkali metal, ammonium, alkaline earth metal salts and mixtures thereof. Of the foregoing, boric acid itself constitutes the preferred material.

A further essential constituent of the electroplatinag bath is an amine which is compatible and soluble in the operating bath having the formula:

$$R—NH—[(CH_2)_n—NH]_m—(CH_2)_p—X—R'$$

Wherein:

n, m and p are integers and n is 2 or 3, m is 1 or 2 or 3, and p is 2 or 3;

X is O or NH; and

R and R' are the same or different and are H, $—CH_2CH{=}CH_2$, $—CH_2CH_2CH_2SO_3$ or $$—CH_2\underset{\underset{OH}{|}}{C}HCH_2OH$$

Typical amines suitable for use in the bath which correspond to the foregoing formula are triethylene tetramine in which R and R' are H, X is NH, and n, m and p are 2; dipropylene triamine in which R and R' are H, X is NH, m is 1 and n and p are 3; and 2-(2-amino ethylamino) ethanol in which R and R' are H, X is O, m is 1 and n and p are 2.

The concentration of the amine is controlled in relationship to the quantity of nickel ions present in the bath. The mol ratio of nickel ions to amine present in the solution can range from about 1:1 up to about 1:4, preferably 1:1.5 to about 1:2.5 with ratios of about 1:2 being particularly satisfactory. Mol ratios in excess of about 1:4 are undesirable since the high concentration of amine inhibits deposition of nickel from the bath while ratios below about 1:1 do not provide a substantially black nickel deposit.

In addition to the nickel ions, borate ions and amine the bath further contains as an essential constituent, bath soluble compatible and inert salts to enhance the conductivity of the electrolyte. Such conductivity salts typically comprise alkali metal sulfate and halides as well as magnesium sulfate and magnesium halide salts. The term "alkali metal" is herein employed in its broad sense to include the alkali metals sodium, potassium, lithium as well as ammonium.

Such conductivity salts or mixtures thereof are employed in amounts of at least about 10 g/l up to the solubility limit thereof with amounts ranging from about 30 up to about 50 g/l being preferred. Sodium sulfate in combination with boric acid constitutes a particularly satisfactory bath composition.

In addition to the foregoing, the bath may further contain as an optional constituent, a darkening enhancing agent which is present in controlled amounts so as to further enhance the darkness or black finish of the deposit. Darkening enhancing agents suitable for use are alkali metal salts of sulfur containing compounds including thiocyanates, thiosulfates, bisulfites, sulfites, or the like, as well as mixtures thereof. When used, such darkening enhancing agents can be employed in amounts up to about 25 g/l while amounts of about 1 to about 5 g/l are usually preferred. Normally, concentrations of such darkening enhancing agents above about 25 g/l are undesirable due to the degradation products formed by the use of such high concentrations which in some instances impair the uniformity and coverage of the black nickel deposit. In addition, no particular benefits are achieved by employing such agents in amounts greater than 25 g/l in comparison to that obtained when using lesser amounts such as about 5 g/l.

As a further optional constituent, the electroplating bath can incorporate any one of a variety of bath compatible wetting agents in effective amounts of the various types conventionally employed in nickel plating solutions. Normally, wetting agents of the anionic type are employed in concentrations up to about 200 mg/l while amounts of about 50 to about 100 mg/l are preferred. Typical of suitable wetting agents that can be employed are sulfates of primary alcohols containing 8 to 18 carbon atoms such as sodium lauryl sulfate, sodium lauryl ethoxy sulfates or sulfonates and the like.

In accordance with the process aspects of the present invention, the operating bath temperature can range from room temperature (70° F.) up to about 150° F. with temperatures of from about 80° F. to about 90° F. being particularly preferred from an energy conservation standpoint. The particular temperature employed will vary to achieve optimum black nickel deposits depending upon the specific composition and operating conditions employed.

The aqueous operating bath is controlled from a range of about pH 4 up to pH 12 while pH range of about 6 to about 10 is preferred. Adjustment of the appropriate pH can be achieved employing acids such as sulfuric acid and hydrochloric acid on the one hand, or employing a base such as an alkali hydroxide including ammonium hydroxide.

The electrodeposition of the black nickel deposit can be effected employing an average current density ranging from as low as about 2 up to about 25 ASF. Preferably, the current density is controlled within a range of about 5 to about 15 ASF.

The duration of plating can broadly range from as low as about 1 up to about 10 minutes depending upon the particular bath composition used, the type of the substrate employed, the type of finish desired and the specific current density used. Normally, plating times ranging from about 2 to about 3 minutes are satisfactory.

The electrodeposition of the black nickel coating can be satisfactorily achieved on conductive metal substrates, including nickel, copper, brass, electrodeposited zinc, cadmium, and the like. In order to achieve a lusterous bright, substantially black nickel deposit, it is preferred that the substrate be in a bright condition either by depositing a bright electrodeposit on the surface or by mechanical means such as buffing, or the like. As the substrate becomes less bright, then the resultant nickel deposit tends to progressively become grayer.

In order to further illustrate the composition and method of the present invention, the examples are provided. It will be understood that the examples are provided for illustrative purposes and are not intended to be limiting of the scope of the present invention as herein described and as set forth in the subjoined claims.

EXAMPLE 1

A commercial electroplating solution is prepared consisting of 17 g/l of $NiSO_4.6H_2O$, 14 g/l of 2 (2-aminoethylamino) ethanol, 5 g/l NaCNS, 37.5 g/l of $Na_2SO_4$, and 0.2 g/l of an anionic wetting agent. The pH is adjusted to 6 with $H_2SO_4$. A work rack containing a plurality of household plumbing fixtures of complex shape is immersed into the solution and plated for 2 to 3 minutes at 10 ASF and 75° F. The deposit is satisfactory on the high and intermediate current density areas of the workpieces but is of an unsatisfactory rainbow appearance in the low current density deep-recess areas. In an effort to overcome this problem, the average current density of the electroplating operation is increased to 15 ASF and a second rack of the same workpieces is plated. This time, an improvement of the deposit in the low current density areas is obtained but a dull gray cloudiness is obtained in the deposit on the high current density areas.

EXAMPLE 2

An electroplating solution is prepared as in Example 1 with the exception that in addition to the constituents previously employed, 22.5 g/l boric acid are added. A work rack containing the same workpieces is immersed into the solution and plated for 2 to 3 minutes at 10 ASF and 75° F. The deposit is uniformly black with good adhesion over the entire surface including the low current density deep recess areas. A second work rack of fresh workpieces is plated in this solution under the same conditions but at an average current density of 15 ASF. Again, the deposit is uniformly black with good adhesion including the high current density areas.

The use of the borate ions and conductivity salts also enables electrodeposition of uniform black nickel deposits in less time because of the increased throwing power of the bath and its improved plating characteristics.

While it will be apparent that the invention herein disclosed is well calculated to achieve the benefits and advantages as hereinabove set forth, it will be appreciated that the invention is susceptible to modification, variation and change without departing from the spirit thereof.

What is claimed is:

1. A bath for electrodepositing a substantially black nickel deposit on a substrate comprising an aqueous solution having a pH of about 4 to about 12 and containing about 2 to about 25 g/l nickel ions, at least about 7 g/l borate ions, at least about 10 g/l of bath soluble and compatible inert conductivity salts and a bath soluble amine present in an amount to provide a mol ratio of nickel to amine in the solution of about 1:1 to about 1:4, said amine corresponding to the formula:

$$R—NH—[(CH_2)_n—NH]_m—(CH_2)_p—X—R'$$

Wherein:

n, m and p are integers and n is 2 or 3, m is 1 or 2 or 3, and p is 2 or 3;

X is O or NH; and

R and R′ are the same or different and are H, $—CH_2CH{=}CH_2$, $—CH_2CH_2CH_2SO_3$ or $$—CH_2\underset{\underset{OH}{|}}{C}HCH_2OH$$

2. The bath as defined in claim 1 in which said nickel ions are present in an amount of about 6 to about 10 g/l.

3. The bath as defined in claim 1 in which said amine is present to provide a mol ratio of nickel to amine of about 1:1.5 to about 1:2.5.

4. The bath as defined in claim 1 in which said amine is present to provide a mol ratio of nickel to amine of about 1:2.

5. The bath as defined in claim 1 in which said borate ions are present in an amount of about 7 g/l up to their solubility limit in the bath.

6. The bath as defined in claim 1 in which said borate ions are present in an amount of about 15 to about 30 g/l.

7. The bath as defined in claim 1 in which said conductivity salts are present in an amount of about 10 g/l up to their solubility limit in the bath.

8. The bath as defined in claim 1 in which said conductivity salts are selected from the group consisting of alkali metal and ammonium sulfates, alkali metal and ammonium halides, magnesium sulfate, magnesium halide as well as mixtures thereof and are present in an amount of about 30 to about 50 g/l.

9. The bath as defined in claim 1 in which said borate ions are present in an amount of about 15 to about 30 g/l and said conductivity salts are present in an amount of about 30 to about 50 g/l.

10. The bath as defined in claim 1 in which said borate ions are present as boric acid in an amount of about 15 to about 30 g/l and said conductivity salts include sodium sulfate in an amount of about 30 to about 50 g/l.

11. The bath as defined in claim 1 further including as a darkening enhancing agent an alkali metal sulfur compound selected from the group consisting of thiocyanates, thiosulfates, bisulfites, sulfites, and mixtures thereof present in an amount up to about 25 g/l.

12. The bath as defined in claim 11 in which said darkening enhancing agent is present in an amount of about 1 to about 5 g/l.

13. The bath as defined in claim 1 further including up to about 200 mg/l of a bath compatible wetting agent.

14. The bath as defined in claim 13 in which said wetting agent comprises an anionic wetting agent and is present in an amount of about 50 to about 100 mg/l.

15. The bath as defined in claim 1 in which said amine is selected from the group consisting of triethylene tetramine, dipropylene triamine, 2-(2-amino ethylamino) ethanol, and mixtures thereof.

16. A method for electrodepositing a substantially black nickel deposit on a substrate which comprises the steps of electrodepositing nickel at a current density of about 2 to about 25 ASF for a period of time sufficient to deposit the desired thickness of deposit from an aqueous solution as defined in claim 1, 2, 3, 4, 5, 6, 7, 8, 9, 10, 11, 12, 13, 14, or 15 at a temperature of about room temperature up to about 150° F.

* * * * *